United States Patent [19]

Ginter et al.

[11] 4,171,935

[45] Oct. 23, 1979

[54] ANTI-SNAG FINISH SOLUBLE IN NON-AQUEOUS SOLVENTS

[75] Inventors: Thomas O. Ginter, Sanford; Robert W. Simmons, Midland, both of Mich.

[73] Assignee: The Dow Chemical Company, Midland, Mich.

[21] Appl. No.: 830,528

[22] Filed: Sep. 6, 1977

[51] Int. Cl.[2] ..... B05D 1/18; B05D 3/02

[52] U.S. Cl. ..... 427/390 R; 427/430 R; 526/317; 526/320

[58] Field of Search ..... 427/390 R, 421, 430 R; 526/317, 320

[56] References Cited

U.S. PATENT DOCUMENTS

| | | | |
|---|---|---|---|
| 2,868,676 | 1/1959 | Ljungbo | 427/390 X |
| 3,821,172 | 6/1974 | Sugiura et al. | 260/897 X |
| 3,852,102 | 12/1974 | Lalk et al. | 427/390 X |
| 3,900,663 | 8/1975 | Barabas et al. | 428/254 |

*Primary Examiner*—Michael R. Lusignan

[57] ABSTRACT

The snagging of a fabric is reduced by treating the fabric with an organic solvent solution of a copolymer of a hydroxyalkyl acrylate, an acrylonitrile, an alkyl acrylate, and acrylic acid. The organic solution is readily prepared by solution polymerizing the named monomers in an organic reaction solvent, such as a mixture of toluene and n-butanol, stripping the reaction solvent, and then dissolving the polymerized product in an organic application solvent such as perchloroethylene or 1,1,1-trichloroethane.

9 Claims, No Drawings

ANTI-SNAG FINISH SOLUBLE IN NON-AQUEOUS SOLVENTS

BACKGROUND OF THE INVENTION

This invention relates to methods for improving the snag resistance of fabrics, particularly, to such methods which require treating the fabric with an alkyl acrylate copolymer dispersed in a liquid carrier and compositions thereof.

Recently, there has been a trend in the garment industry away from woven fabrics to knit fabrics, which has created serious manufacturing problems. Especially troublesome is the cutting operation wherein, because of the tendency of the knit fabrics to sag, stretch, etc., only a few layers of fabric can be cut at any one time. In addition, knit fabrics usually require up to 24 hours to relax on the cutting table before being cut to insure the fabric has returned to its original dimension after being stretched as it was laid on the table.

These same problems exist with the finished garment, wherein the knit fabrics have a greater tendency to snag than conventional woven materials. The snagging tendency is particularly bothersome with lighter weight fabrics as are used for wearing apparel. Thus, there exists a need for a treatment for knit fabrics to reduce their tendency to snag and provide more dimensional stability.

Recently, as disclosed in U.S. Pat. No. 3,852,102 an aqueous dispersion of a particular copolymer has been applied to, and cured on, the fabric thereby improving its snag resistance. While this practice provides the desired solution of most of the aforementioned problems, many fabric manufacturers employ organic solvent finishing equipment which cannot handle aqueous polymer solutions. A considerable capital outlay would be required to convert these solvent finishing units to permit the use of aqueous finishing systems. Furthermore, it was found that the polymer as prepared was insoluble in the chlorinated solvents used throughout the textile industry. As a means of circumventing this problem, application Ser. No. 573,484 filed May 1, 1975 provides a method of emulsifying the aqueous copolymer dispersion in organic solvents. This method reduces the capital expenditure required. However, an additional piece of equipment is necessary to separate the organic solvent and water after drying the fabric before their reentry into the system. Thus, removal of all water from the finishing process is essential.

In view of the stated deficiencies of prior art methods, it remains highly desirable to provide a method of reducing snagging using a non-aqueous finish containing an oil-soluble polymer which is equal in performance to that of the aqueous finish described in U.S. Pat. No. 3,852,102.

SUMMARY OF THE INVENTION

One aspect of the present invention is a method of reducing fabric snagging comprising the steps of (1) applying to the fabric an organic copolymer solution containing an organic application solvent having dissolved therein a soluble copolymer of from about 25 to about 50 weight percent of a hydroxyalkyl acrylate, from about 6 to about 12 weight percent of an acrylonitrile, from about 40 to about 60 weight percent of an alkyl acrylate, and from about 1 to about 5 weight percent of an acrylic acid in an amount effective to impart snag resistance and (2) removing the organic application solvent whereby the effective amount of copolymer remains on the fabric. Another aspect of the present invention is a method of preparing the copolymer by means of solution polymerization in an organic reaction solvent. Yet another aspect of the present invention is an organic solution of the copolymer comprising the copolymer dissolved in an organic application solvent used in the textile industry.

It has been found that an organic solution of the copolymer (hereinafter called organic copolymer solution) can be prepared when the copolymer is prepared by solution polymerization. As a result, the organic copolymer solution of this invention can be effectively applied to the fabric from the conventional organic solvent application techniques and apparatus.

Upon removal of the organic application solvent from the treated fabric, the copolymer can be cured to a tough resilient coating thereby imparting improved snag resistance to the fabric.

DETAILED DESCRIPTION OF PREFERRED EMBODIMENTS

The organic copolymer solution is a solution comprising an organic application solvent having dissolved therein a copolymer of a hydroxyalkyl acrylate, an acrylonitrile, an alkyl acrylate and an acrylic acid.

An organic application solvent suitable for the purposes of this invention is any normally volatile organic solvent which may be suitably applied to fabric without causing loss of fabric physical properties and which will dissolve enough of the copolymer to provide at least a 2 weight percent solution of the copolymer, preferably at least a 5 weight percent solution. A normally volatile organic solvent is a material which is a liquid at ambient temperature and which exhibits a vapor pressure of at least 10 mm at 20° C. and 760 mm Hg. Examples of suitable organic application solvents include chlorinated hydrocarbon solvents such as methylene chloride, perchloroethylene and 1,1,1-trichloroethane; aromatic hydrocarbons such as toluene and xylene and aliphatic ketones such as acetone and methylethyl ketones. Preferred application solvents are the chlorinated hydrocarbon solvents, especially, 1,1,1-trichloroethane and perchloroethylene.

A suitable copolymer is a solution polymerizate of a monomeric mixture comprising from about 25 to about 50 weight percent of an hydroxyalkyl acrylate, from about 6 to about 12 weight percent of an acrylonitrile, from about 40 to about 60 weight percent of an alkyl acrylate and from about 1 to about 5 of an acrylic acid.

Preferred copolymers are solution polymerizates comprising from about 30 to about 45 weight percent of hydroxyalkyl acrylate; from about 7 to about 11 weight percent acrylonitrile; from about 45 to about 55 weight percent of alkyl acrylate; from about 1 to about 3 weight percent of an acrylic acid. Since essentially all of the monomeric mixture polymerizes, it is reasonably presumed that the resulting copolymer contains the aforementioned monomeric components in substantially the same proportions.

The term "a hydroxyalkyl acrylate" includes the copolymerizable members of the hydroxyalkyl acrylates, hydroxyalkyl methacrylates and mixtures thereof. Of particular interest are those having alkyl groups that contain from two to four carbon atoms. Representative examples include hydroxyethyl acrylate, hydroxypropyl acrylate, hydroxybutyl acrylate, hydroxyethyl methacrylate and hydroxypropyl methacrylate. Preferred are the hydroxyalkyl esters of acrylic acid such as 2-hydroxyethyl acrylate and 2-hydroxypropyl acrylate. Especially preferred is hydroxypropyl acrylate.

The term "an alkyl acrylate" includes the copolymerizable members of the alkyl acrylates, alkyl methacrylates and mixtures thereof. Of particular interest are those copolymerizable alkyl acrylates wherein the alkyl has from two to eight carbon atoms. Representative examples include propyl acrylate, ethyl acrylate, butyl acrylate, pentyl acrylate and ethyl methacrylate. Preferred are alkyl esters of acrylic acid such as ethyl acrylate, propyl acrylate and butyl acrylate. Especially preferred are ethyl acrylate and butyl acrylate.

The term "an acrylic acid" includes both acrylic and methacrylic acids or a mixture of the two. The term "an acrylonitrile" includes both acrylonitrile and methacrylonitrile.

The copolymer is advantageously prepared by copolymerizing the aforementioned comonomers dissolved in an organic reaction solvent under conditions such as temperature and initiator effective to cause solution polymerization. In the practice of a preferred solution polymerization method, the reaction solvent is first heated to the desired reaction temperature and allowed to stabilize at that temperature. The polymerization initiator and aforementioned comonomers are then added to the preheated reaction mixture. Preferably, the initiator is added continuously during the reaction period which is usually from about 0.5 to about 6 hours, although intermittent addition or addition at specified intervals is possible. The comonomers are added either individually or as a preblended comonomeric mixture. Advantageously, the monomers are also added continuously over the entire reaction period, although intermittent addition or addition at specified intervals during the polymerization process is possible. Addition of the monomers whether continuously or intermittently, is advantageously such that each monomer's rate of addition is proportional to its concentration in the polymerized product. Total monomer charged during the reaction beneficially remains below about 50 percent of the total weight of the reaction solvent to avoid viscosity problems upon polymerization.

The organic reaction solvent in this invention is suitably any organic solvent or mixture of miscible organic solvents which does not polymerize with the monomers of this invention and in which the monomers to be polymerized and the resultant copolymer are soluble, i.e., will form at least a 50 weight percent solution. Preferably, the reaction solvent should resist chain transfer and be easily removed from the copolymer by stripping, drying, coagulation or the like. Examples of suitable solvents include tetrahydrofuran, ethoxyethyl acetate, perchloroethylene, 1,1,1-trichloroethane, a mixture of toluene and butyl alcohol and lower alkyl glycol ethers such as ethylene glycol, ethyl ether and ethylene glycol methyl ether. Preferred reaction solvents are 2-ethoxyethyl acetate and a mixture of from about 60 to about 90 weight percent of toluene and from about 40 to about 10 weight percent of butyl alcohol. The most preferred reaction solvent is a mixture of toluene and butyl alcohol. Advantageously, the percent butyl alcohol increases with increasing amount of hydroxyalkyl acrylate monomer. Typically, a mixture of from about 70 to about 90 weight percent of toluene and from about 10 to 30 weight percent of butyl alcohol is advantageously employed.

The polymerization initiator can be any of a number of conventionally used free-radical generating initiators including bisulfites, persulfates, peroxygen compounds; e.g., t-butyl peroxide and peroxygen esters and azo compounds; e.g., azobisisobutyronitrile. Initiator concentration is suitably any amount effective to cause polymerization and is usually dependent upon the particular initiator, the reaction solvent, the degree of polymerization required and reaction parameters. Typically, effective concentrations vary between about 0.5 to about 2 percent of the polymer weight. For example, azobisisobutyronitrile has been found to be particularly effective when used at about 1 percent of the polymer weight.

Typically, solution polymerization is carried out at reaction temperatures of between about 20 and about 150° C. Such reaction temperatures should provide essentially complete conversion within reaction time periods of from about 0.5 hour to about 6 hours. However, temperatures most advantageously employed for polymerization are dependent upon the particular monomeric constituents, their amounts, and the initiator system employed. For example, when polymerizing the preferred monomers using 1 weight percent of azobisisobutyronitrile as the polymerization initiator, the reaction temperature is advantageously within the range from about 80° C. to about 100° C. with reaction time periods from about 2 to about 5 hours. During polymerization it is desirable to maintain constant agitation throughout the reaction solvent. Agitation is readily accomplished with conventional mixing apparatus such as stirrers, pumps, and the like.

When the reaction solvent is the organic application solvent as hereinbefore defined, the organic copolymer solution is suitable for applying the copolymer to the fabric upon dilution to the desired concentration. When the reaction solvent cannot be suitably employed as the organic application solvent upon completion of the polymerization reaction, the reaction solvent is removed by vacuum stripping, drying, or other conventional means. It is desirable to remove the maximum possible amount of reaction solvent. The resultant copolymer is then dissolved in the desired organic application solvent to provide a solution containing from about 1 to about 8 weight percent of the copolymer, preferably from about 2 to about 5 weight percent, based on the weight of the solution.

Although many of the benefits of the invention are achieved by the use of the unmodified copolymer, it is often desirable to cross-link the copolymer with certain functional ingredients for special effects or to tailor the coating for a particular family of properties. For example, dry cleaning permanence is imparted by use of a polyfunctional organic compound having at least two functional groups reactive with the carboxylic or hydroxyl moieties of the copolymer. Thus, a small amount, e.g., from about 0.5 to about 10 weight percent based on copolymer, of a melamine resin will improve those named properties without deleteriously affecting the hand of the treated fabric. The melamine resin can be added directly to the polymer/application solvent mixture. The desired cross-linking is then accomplished during the heating of the treated fabric that is normally employed to remove the application solvent.

The composition (often called finish) can be applied to the fabric by known means conventionally used in the textile industry such as spraying, pad bath or other suitable means. The finish may be applied after dyeing and scouring and before heat treating or to the finished fabric or garment. It is advantageous to apply the finish prior to heat setting. The subsequent exposure to elevated temperatures enables the copolymer to cross-link, e.g., with the aid of a melamine resin. Preferably, in order to permit sufficient cross-linking, when desired, and to remove excess organic application solvent, the fabric should be exposed to temperatures from about 115° C. and about 150° C. for a period from about 1.5 to about 3 minutes.

The finish is preferably applied to the fabric at concentrations within the range of about 1 to about 5 percent of copolymer based on the weight of the fabric. Within this range the polymer does not significantly affect the aesthetic characteristics of the hand of the fabric and does provide the benefits of the invention.

The following example is set forth to illustrate the invention and should not be construed to limit its scope. In the example, all parts and percentages are by weight.

EXAMPLE

To a 250 milliliter three necked flask equipped with a thermocouple, thermometer, stirrer, heating device and addition funnel is added 100 parts of a reaction solvent consisting of 80 weight percent toluene and 20 weight percent of butyl alcohol. The flask is stirred and heated to 90° C. and a monomer charge consisting of the following ingredients:

| Ingredient | Parts |
|---|---|
| Hydroxypropyl acrylate | 28.8 |
| Butyl acrylate | 30.8 |
| Acrylonitrile | 6.0 |
| Acrylic Acid | 1.3 |
| Azobisisobutyronitrile | 0.7 |

is added over a period of 2 hours. The flask is maintained at 90° C. and stirred for an additional one hour. At the end of this period the flask is cooled and the reaction solvent is vacuum stripped. The resulting copolymer is dissolved in 1,1,1-trichloroethane.

Several double knit fabric samples (10 oz. by weight) are passed through a conventional textile pad bath set to give 100 percent weight pick-up of a 1,1,1-trichloroethane solvent containing 2 percent solids of a copolymer prepared in accordance with this invention and having the composition of 43 percent of hydroxypropyl acrylate, 9 percent of acrylonitrile, 46 percent of butyl acrylate, and 2 percent of acrylic acid. Five percent, based on polymer weight, of a melamine resin, sold commercially by Americal Cyanamid as Cymel® 301, is also contained in the solvent. After application of this composition the fabric samples are dried in a forced air oven for two minutes at 150° C. Weighing the fabric samples after drying shows that the fabric contains 1.6 percent of the combined copolymer and melamine resin based on the treated fabric weight. Samples treated in this manner are designated Sample 1. Several other samples remain untreated and are designated as Sample 2.

One untreated and one treated fabric sample are subjected to 5 commercial detergent washes; while another sample of each is subjected to 5 drycleaning cycles. The commercial detergent washes consist of washing the fabric samples in a commercial washing detergent (Tide), without additional softeners or other additives, at the manufacturer's recommended detergent level for 5 standard cycles. Each cycle consists of a wash, two rinses and a spin dry step. Each drycleaning cycle consists of a standard drycleaning cycle using a commercial chlorinated hydrocarbon drycleaning solvent (Perchloroethylene CS) as the cleaning fluid.

Original, commercial detergent washed, and drycleaned samples are evaluated for snagging using an ICI Mace Snagger. Results of this testing are presented in Table I.

TABLE I

| | ICI Mace Snagger[1] | |
|---|---|---|
| | Sample 1 | Sample 2* |
| Original | 2.5 | 1.5 |
| 5 Commercial Detergent Washes | 3.5 | 2.5 |
| 5 Drycleaning Cycles | 2.0 | 1.0 |

*Not an example of this invention

[1]In this test a sleeve of fabric is slipped over a cylinder which is rotated counter-clockwise for 600 revolutions with a spiked spherical mace bouncing against the fabric. After exposure to the mace snagger, each sample is removed from the cylinder and ironed for 12 seconds with a 5-pound steam iron. Ratings are based on the comparison of the experimental samples after testing to standard photographs. Ratings range from 1 to 5, with 1 being the largest number of snags and 5 representing a sample with no snags.

As evidenced by the foregoing data of Table I, the samples of fabric treated in accordance with this invention exhibit effective snag resistance; nearly twice that of the untreated fabric samples.

What is claimed is:

1. A method for reducing the snagging of fabric comprising the steps of (1) applying to the fabric an organic copolymer solution containing an organic application solvent having dissolved therein a soluble copolymer comprising from about 25 to about 50 weight percent of a hydroxyalkyl acrylate, from about 6 to about 12 weight percent of an acrylonitrile, from about 40 to about 60 weight percent of an alkyl acrylate and from about 1 to about 5 weight percent of an acrylic acid in an amount effective to impart snag resistance and (2) removing the organic application solvent whereby the effective amount of copolymer remains on the fabric.

2. The method of claim 1 wherein said fabric is a knit fabric.

3. The method of claim 1 wherein said hydroxy alkyl acrylate is hydroxypropyl acrylate.

4. The method of claim 3 wherein said alkyl acrylate is n-butyl acrylate.

5. The method of claim 4 wherein said organic application solvent is a chlorinated hydrocarbon solvent.

6. The method of claim 1 wherein the organic copolymer solution also contains an amount of a polyfunctional organic compound having at least two functional groups reactive with the carboxyl or hydroxyl groups of the copolymer, said amount being effective to cross-link the copolymer.

7. The method of claim 6 wherein said polyfunctional organic compound is a melamine resin which is present in the solution in an amount from about 0.5 to about 10 weight percent based on the weight of the copolymer.

8. The method of claim 1 wherein the amount of the copolymer in the organic copolymer solution is from about 1 to about 8 weight percent based on the weight of the solution and the solution is applied by passing the fabric through a pad bath.

9. The method of claim 1 wherein the copolymer is a copolymer of from about 30 to about 45 weight percent of a hydroxyalkyl acrylate wherein alkyl has from 2 to 4 carbons; from about 7 to about 11 weight percent of acrylonitrile; from about 45 to about 55 weight percent of an alkyl acrylate wherein alkyl has from 2 to 8 carbons and from about 1 to about 3 weight percent of acrylic acid, and the amount of the copolymer in the organic copolymer solution is from about 2 to about 5 weight percent based on the weight of the solution.

* * * * *